US008307684B2

(12) United States Patent
Matsutani et al.

(10) Patent No.: US 8,307,684 B2
(45) Date of Patent: Nov. 13, 2012

(54) BENDING METHOD OF MEDICAL SUTURING NEEDLE

(75) Inventors: Kanji Matsutani, Utsunomiya (JP); Tadashi Otsuka, Utsunomiya (JP); Kazuaki Kato, Utsunomiya (JP)

(73) Assignee: MANI, Inc., Tochigi (JP)

( * ) Notice: Subject to any disclaimer, the term of this patent is extended or adjusted under 35 U.S.C. 154(b) by 177 days.

(21) Appl. No.: 12/670,782

(22) PCT Filed: Jul. 14, 2008

(86) PCT No.: PCT/JP2008/062667

§ 371 (c)(1), (2), (4) Date: Jul. 6, 2010

(87) PCT Pub. No.: WO2009/016946

PCT Pub. Date: Feb. 5, 2009

(65) Prior Publication Data

US 2010/0263425 A1 Oct. 21, 2010

(30) Foreign Application Priority Data

Jul. 27, 2007 (JP) ..... 2007-195496

(51) Int. Cl.
*B21D 11/08* (2006.01)

(52) U.S. Cl. ..... 72/167; 72/170; 72/175; 72/306

(58) Field of Classification Search ..... 72/166–175, 72/306

See application file for complete search history.

(56) References Cited

U.S. PATENT DOCUMENTS 5,388,441 A * 2/1995 Bogart et al. ..... 72/133
5,425,258 A * 6/1995 Bogart ..... 72/169
5,431,036 A * 7/1995 Bogart ..... 72/171
5,450,739 A * 9/1995 Bogart et al. ..... 72/133
7,937,981 B2 * 5/2011 Reynolds et al. ..... 72/306

FOREIGN PATENT DOCUMENTS

JP 067050/1981 11/1982
JP 3078339 B2 8/2000

OTHER PUBLICATIONS

International Search Report for PCT/JP2008/062667 dated Feb. 3, 2010.*

* cited by examiner

*Primary Examiner* — Bena Miller
(74) *Attorney, Agent, or Firm* — Smith Patent Office

(57) ABSTRACT

There is provided a method of bending a medical suturing needle curved at different curvature radii in a length direction more reasonably.

A bending method which curves a medical suturing needle at different curvature radii (r, R) in a length direction, wherein molded surfaces 11*a* to 11*c* corresponding to the curved shape of a suturing needle A curved at different curvature radii in a length direction on the outer circumferential surface of a reciprocatively rotated bending die 11 are formed, the outer circumferential surface of the bending die 11 and a press roll 14 interpose a belt 12 having flexibility therebetween and are relatively pressed, a rod-shaped material 1 is interposed into between the outer circumferential surface of the bending die 11 and the belt 12 at a point P where the outer circumferential surface of the bending die and the press roll 14 are pressed, the bending die is reciprocatively rotated in a winding direction (in the direction indicated by the arrow a) and in a rewinding direction (in the direction indicated by the arrow b), and the material 1 is curved at different curvature radii in a length direction.

4 Claims, 5 Drawing Sheets

BENDING METHOD OF MEDICAL SUTURING NEEDLE

TECHNICAL FIELD

The present invention relates to a bending method of a curved medical suturing needle. More specifically, the present invention relates to a bending method advantageous for manufacturing a medical suturing needle curved at substantially the same curvature radius from a needle tip to a trunk portion or a medical suturing needle curved at different curvature radii in a length direction from a needle tip through a trunk portion to a proximal end.

BACKGROUND ART

A medical suturing needle used for suturing biological tissue is typically formed so as to be curved from a needle tip through a trunk portion to a proximal end. The curved shape has substantially the same curvature radius over the entire length and is formed in a shape (at an angle) of a ½ circle) (180°), a ⅜ circle)(135°), or a ¼ circle)(90°).

As a bending method which curves a shaft rod shaped material when the curved medical suturing needle is manufactured, there is a technique described in Patent Document 1. In this technique, a material is inserted into between a cylindrical bending roll and a belt pressed into contact with and wound around the outer circumference of the bending roll and having flexibility, the material is wound by the bending roll and the belt so as to be bent along the outer circumferential surface of a bending die, and the bent material is rewound and is discharged. Thus, the shaft rod shaped material is curved.

A bicurve needle which is a medical suturing needle mainly used for an eye operation is curvedly formed so that a needle tip portion and a trunk portion have different curvature radii. As one bending method of such medical suturing needle, a technique described in Patent Document 2 has been proposed.

In the technique described in Patent Document 2, a straight needle material molded in a predetermined sectional shape is bent from one end side over a predetermined range at the largest curvature radius configuring a curved shape, the bent material is bent from the end of the material over a predetermined range at a curvature radius smaller than the above curvature radius, and the material is bent from the end of the material over a predetermined range so that the curvature radius is sequentially reduced. In this technique, plural bending rolls having different curvature radii corresponding to the curved shape of the medical suturing needle are prepared, and the material is sequentially bent by the bending rolls. Thus, the material can be reasonably bent.

Patent Document 1: U.S. Pat. No. 1,295,902

Patent Document 2: U.S. Pat. No. 3,078,339

DISCLOSURE OF THE INVENTION

The medical suturing needle has a tip formed with a sharp needle tip and is formed so that its thickness is gradually increased from the needle tip to a trunk portion. In the bending method described in Patent Document 1, the needle tip is inserted into between the bending roll and the belt, and the bending roll is rotated to wind the material at a predetermined angle and is rewound. Thus, the material can be bent. The belt is insufficiently pressed into contact with the bending roll in the portion including the needle tip. Accordingly, as illustrated in FIG. 5, the portion including a needle tip 52 of a medical suturing needle 51 cannot be in a sufficient curved shape and maintains a substantially linear shape.

The bending method described in Patent Document 2 can solve the above problems and bend the bicurve suturing needle curved at different curvature radii in a length direction. Even if the target medical suturing needle is set by any curve, it can be reasonably bent. However, it is necessary to bend one material plural times. Therefore, the operation requires long time and is troublesome.

In the bending methods of Patent Documents 1 and 2, the outer circumferential surface of the material is curved so as to be contacted with the outer circumferential surface of the bending roll. When the material is formed with a taper, the center axis of the material is not curved at the same curvature radius. However, in such case, practically, the material is regarded to as being curved by the same curvature radius. This is ditto for the present invention described below.

An object of the present invention provides a method of reasonably bending a medical suturing needle curved at different curvature radii in a length direction, which can reliably curve a portion including a needle tip.

To address the above problems, a first bending method of a medical suturing needle according to the present invention which has a bending die reciprocatively rotated about a rotation center, a belt wound around the outer circumferential surface of the bending die and having flexibility, and a backup member interposing the belt between the outer circumferential surface of the bending die and the backup member which are relatively pressed, interposes a rod-shaped medical suturing needle material between the outer circumferential surface of the bending die and the belt in the portion in which the outer circumferential surface of the bending die and the backup member are relatively pressed via the belt, reciprocatively rotates the bending die in a winding direction and a rewinding direction, and curves the material in a length direction, wherein a curvature radius having a distance from the rotation center to the outer circumferential surface of the bending die is changed corresponding to the rotation angle of the bending die.

A second bending method of a medical suturing needle according to the first bending method, wherein the curvature radius having a distance from the rotation center to the outer circumferential surface of the bending die is formed corresponding to the curved shape of the medical suturing needle curved at different curvature radii in a length direction from a reference point on the outer circumference to the downstream side in a rotation direction.

A third bending method of a medical suturing needle according to the first bending method, wherein the bending die is formed in a cylindrical shape and the rotation center of the bending die is set to a position eccentric from the center of the cylindrical shape.

The first bending method of a medical suturing needle (hereinafter, called a "suturing needle") according to the present invention has a bending die configured so that a curvature radius having a distance from a rotation center to the outer circumferential surface of the bending die is changed corresponding to the rotation angle of the bending die, a belt wound around the outer circumferential surface of the bending die and having flexibility, and a backup member interposing the belt between the outer circumferential surface of the bending die and the backup member which are relatively pressed, interposes a rod-shaped medical suturing needle material between the outer circumferential surface of the bending die and the belt in the portion in which the outer circumferential surface of the bending die and the backup member are relatively pressed, reciprocatively rotates the bending die in a winding direction and a rewinding direction, and can curve the material in a length direction.

Specifically, the curvature radius having a distance from the rotation center to the outer circumferential surface of the bending die (hereinafter, simply called a "curvature radius") is changed corresponding to the rotation angle of the bending die. Therefore, a needle tip is inserted into between the bending die and the belt corresponding to the rotation range in which the curvature radius of the bending die is small so that the very small portion including the needle tip of the material formed with a taper from the needle tip to a trunk portion can be bent at a small curvature radius. The very small portion including the needle tip can be bent like the trunk portion.

In the second bending method of a medical suturing needle, the curvature radius having a distance from the rotation center to the outer circumferential surface of the bending die is formed corresponding to the curved shape of the medical suturing needle curved at different curvature radii in a length direction from a reference point on the outer circumference to the downstream side in a rotation direction. Therefore, the material is inserted at the reference point on the outer circumference of the bending die so as to be curved corresponding to different curvature radii on the outer circumferential surface of the bending die.

In the third bending method of a medical suturing needle, the bending die is formed in a cylindrical shape and the rotation center of the bending die is set to a position eccentric from the center of the cylindrical shape. Therefore, the distance between the rotation center of the bending die and the center of the cylindrical shape is appropriately set so that the dimension of the curvature radius can be set.

In the above bending methods, the material is interposed between the bending die and the belt and is bent at one time. Accordingly, the material can be curved in the curved shape of the target suturing needle, and the reasonable bending method excluding the trouble of the operation can be realized.

EXPLANATION OF THE REFERENCE NUMERALS

Figure 1:
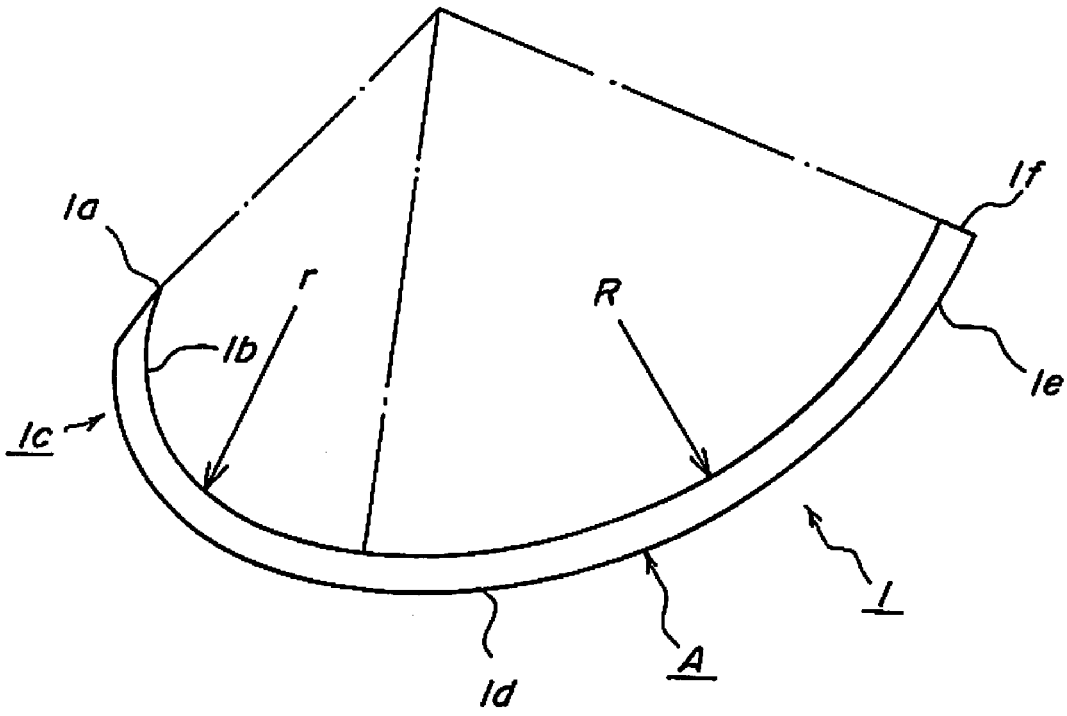
FIG. 1 is a diagram describing an example of a suturing needle curved at different curvature radii from a needle tip through a trunk portion to a proximal end.

A Suturing needle
B Bending device
O Rotation center of a bending die
P Reference position of a molded surface
1 Material
1*a* Needle tip
1*b* Cutting edge
1*c* Cutting portion
1*d* Trunk portion
1*e* Proximal end
1*f* Proximal end face
11 Bending die
11*a* to 11*c* Molded surface
12 Belt
13*a* Supply roll
13*b* Winding roll
14 Press roll
15 Urging member
20 Bending die

BEST MODE FOR CARRYING OUT THE INVENTION

The most preferred embodiment of a bending method of a suturing needle according to the present invention will be described below. The bending method of a suturing needle of the present invention is realized by bending the suturing needle curved in a length direction from a needle tip through a trunk portion to a proximal end at one time for molding. That is, when the curved shape of the target suturing needle from the sharp needle tip through the trunk portion to the proximal end has some different curvature radii, the suturing needle can be easily and reliably bent atone time without being bent at each of the different curvature radii. When the curved shape of the target suturing needle from the sharp needle tip through the trunk portion to the proximal end has substantially the same curvature radius, the suturing needle can be bent so as to be curved at the curvature radius of the portion including the needle tip which is the same as that of the curved shape of the trunk portion or the proximal end.

The sectional shape and function of the suturing needle are not limited in the present invention. Any sectional shape is applicable. For instance, a circular needle having a circular cross section and not having a cutting edge and an angular needle having a triangular cross section and having a cutting edge from the needle tip over a predetermined length range are applicable. In the case of the suturing needle used for an eye operation, a portion to be sutured need be sutured deeply and narrowly. Therefore, advantageously, the suturing needle is in a curved shape having a small radius by increasing the curvature of the needle tip portion. A high effect can be exhibited when the present invention is applied for bending such suturing needle.

When the suturing needle is curved in a shape continuing plural different curvature radii, the present invention is not limited to the curved shape having a large curvature radius of the needle tip portion. Shapes having a large or small curvature radius of the proximal end, a large or small curvature radius of the trunk portion can be formed. The curved shape having, not only bicurve, but also triple curve or more, can be formed. These can be formed by rotating a bending die and appropriately changing the reference position of the molded surface.

The material configuring the suturing needle is not limited. A wire material and a plate material made of steel typified by a piano wire, martensitic stainless steel, and austenitic stainless steel can be used.

Specifically, the suturing needle penetrates through biological tissue to pass a suturing thread therethrough. Accordingly, the suturing needle need to have hardness which can easily pass through the biological tissue and it is not preferable that rust is caused in the distribution process. From this viewpoint, the austenitic stainless steel wire is subjected to cold drawing at a predetermined reduction of area to extend its tissue in fiber. It is preferable to use the material exhibiting high hardness by processing hardening and bending strength by the tissue extended in fiber.

As described above, when the material made of austenitic stainless steel whose tissue is extended in fiber is bent, the possibility that the tip portion including the sharp needle tip can be insufficiently bent due to resistance of the material against bending is high. The bending method of the present invention is advantageous for bending the suturing needle using such material.

The bending die is formed in a shaft rod shape, has an outer circumferential surface formed with a molded surface, and can be reciprocatively rotated. In the shape of the molded surface of the outer circumferential surface of the bending die, the curvature radius having a distance from a rotation center to the outer circumferential surface of the bending die is changed corresponding to the rotation angle of the bending die.

The relation between the change of the curvature radius and the rotation angle of the bending die is not uniquely set and is preferably set in various ways corresponding to the target suturing needle. For example, like the bi curve suturing needle used for an eye operation, when the suturing needle has a curvature radius which largely changes the curved shape set to a path from the needle tip through the trunk portion to the proximal end, the outer circumferential surface of the bending die has a shape corresponding to the curved shape of the target suturing needle to be bent. When the tip portion including the needle tip is curved substantially like the trunk portion and the proximal end, the bending die is formed in a cylindrical shape and the rotation center of the bending die is eccentric from the center of the cylindrical shape.

As described above, the shape of the molded surface need not be always a shape corresponding to the curved shape having continuous different curvature radii configuring the target suturing needle and is preferably formed in consideration of a condition including the properties of the material configuring the suturing needle (e.g., the springback properties).

A belt arranged between the bending die and a backup member is wound around the outer circumferential surface of the bending die to interpose the material of the suturing needle between the belt and the outer circumferential surface and molds the material by the relative press of the backup member and the bending die. The belt needs flexibility and strength so as not to be easily torn.

The belt which satisfies the condition can be used without limiting the material. Such belt includes metal belts such as a steel belt, a stainless belt, and a brass belt. These belts can be selectively used. However, the present invention is not limited to the metal belt and a synthetic resin belt which satisfies the condition can be used.

The backup member and the bending die interpose the belt and are relatively pressed. The backup member molds the material inserted into between the bending die and the belt. When the distance from the rotation center to the outer circumferential surface of the bending die is changed with the rotation of the bending die, the bending die or the backup member is relatively shifted to follow the change of the distance.

The backup member should have the above function and does not limit the configuration and the shape. As the backup member having such function, any of a plate-like member and a cylindrical member setting the dimension of the radius of the bending die according to bending strength can be preferably used.

The configuration pressing the bending die and the backup member is not limited. When a shaft rotatably supporting the bending die is fixed to a frame, the backup member can be urged in a bending die direction by a spring, an air cylinder, or a hydraulic cylinder. When the backup member is fixed to the frame, the bending die can be urged in a backup member direction by a spring, an air cylinder, or a hydraulic cylinder. Any of the configurations can relatively press the bending die and the backup member and can follow the change when the distance from the outer circumferential surface to the rotation center of the bending die is changed with the rotation of the bending die.

First Embodiment

Figure 2:
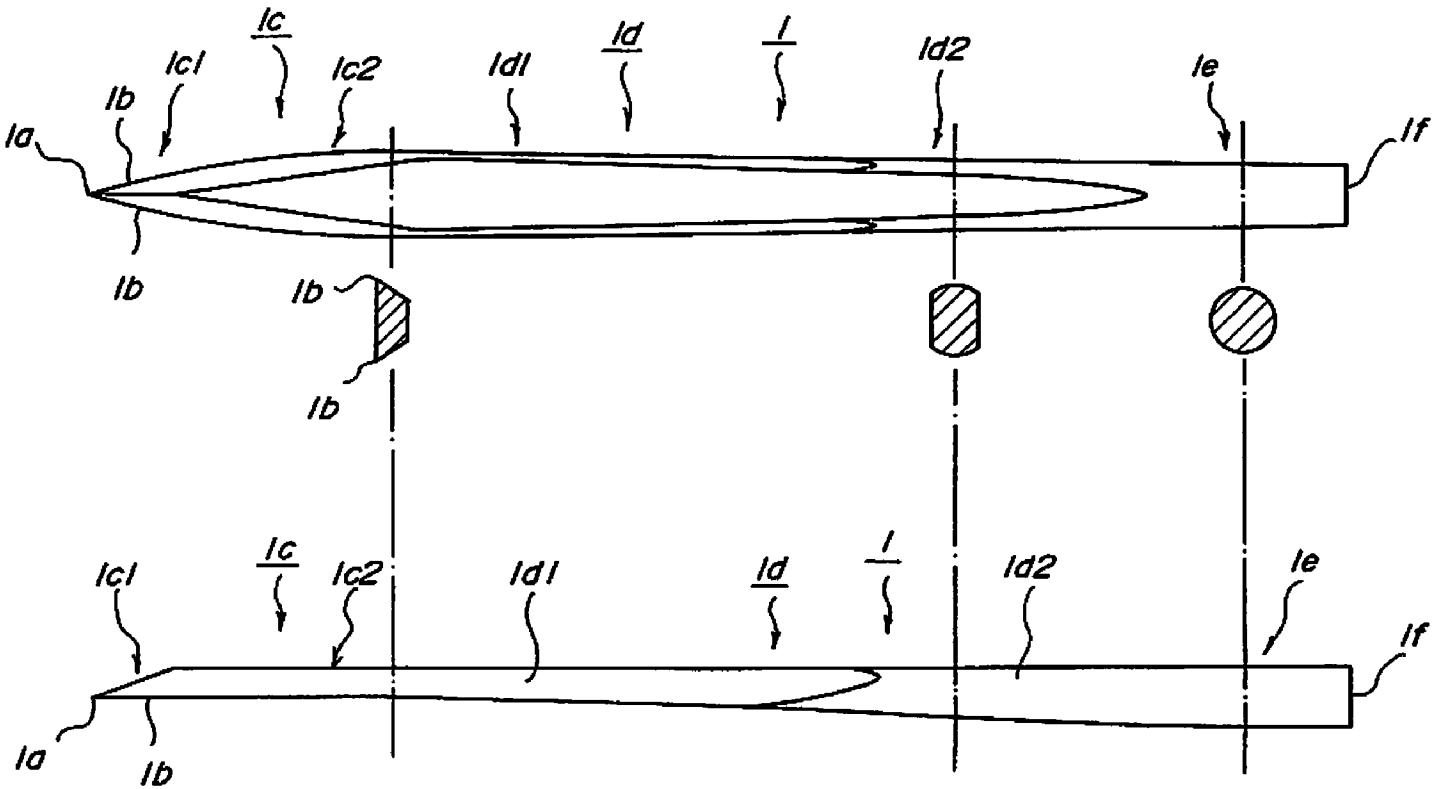
FIG. 2 is a diagram describing the configuration of a material immediately before the suturing needle illustrated in FIG. 1 is bent.
Figure 3:
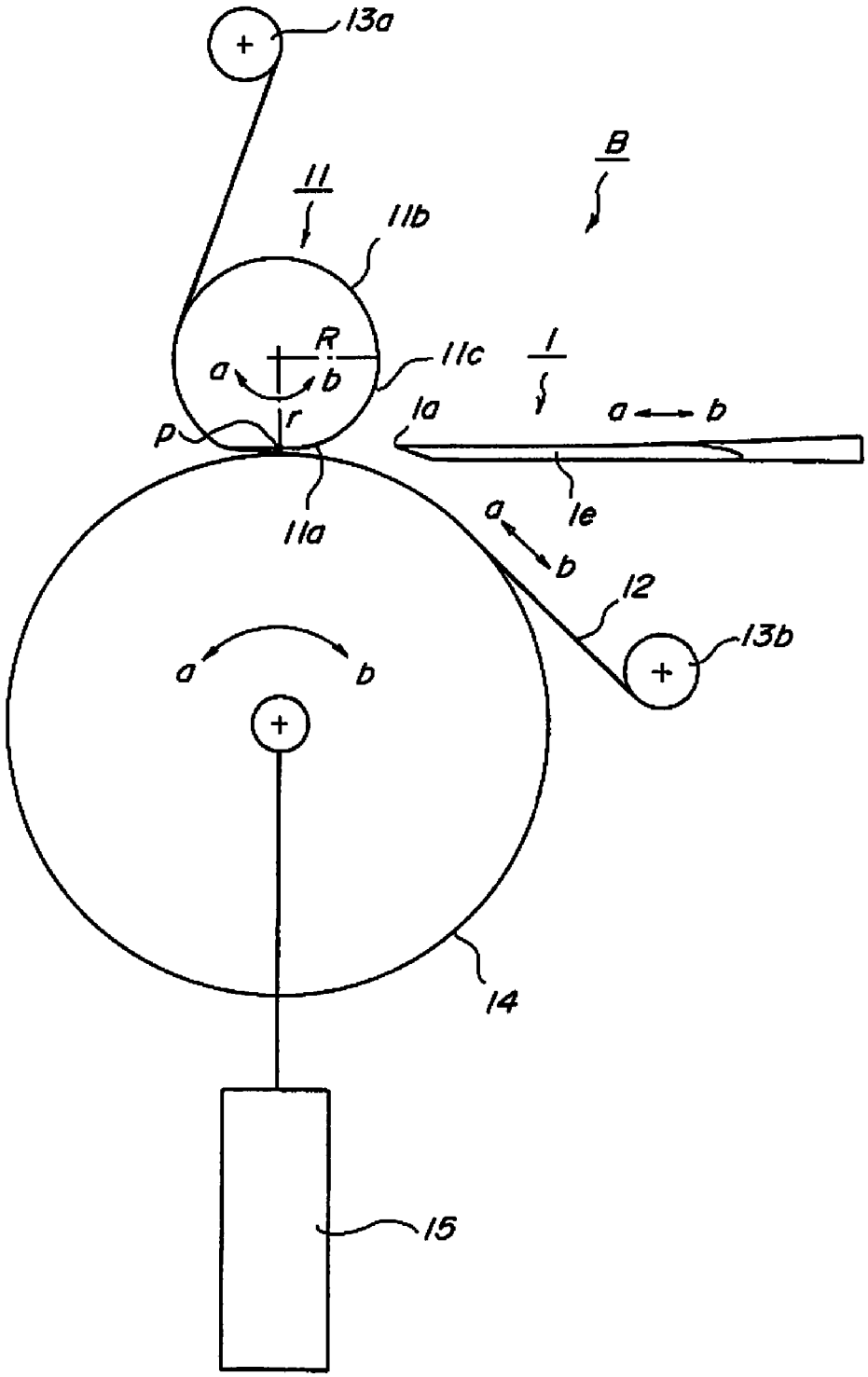
FIG. 3 is a diagram describing an example of a bending device performing bending according to a first embodiment.

A first embodiment of a bending method according to the present invention will be described with reference to the drawings. FIG. 1 is a diagram describing an example of a suturing needle (bicurve suturing needle) curved at different curvature radii from a needle tip through a trunk portion to a proximal end. FIG. 2 is a diagram describing the configuration of a material immediately before the suturing needle illustrated in FIG. 1 is bent. FIG. 3 is a diagram describing an example of a bending device performing bending according to the first embodiment.

A suturing needle A having a curved shape having different curvature radii in a length direction will be described with reference to FIGS. 1 and 2. The suturing needle A is an eye suturing needle called a bicurve needle. A material 1 having a thickness of about 0.1 to 0.4 mm is formed in a curved shape having different curvature radii from a needle tip 1*a* through a cutting portion 1*c* formed with a cutting edge 1*b* and a trunk portion 1*d* to a proximal end 1*e*.

In this embodiment, the material 1 is curved at a radius r having a small curvature radius from the needle tip 1*a* to the cutting portion 1*c* and the trunk portion 1*d* is curved at a radius R having a large curvature radius. The curve at the radius r is formed in a very short range from the needle tip 1*a* to the cutting portion 1*c*. The material 1 is continuously increased from the radius r to the radius R from the cutting portion 1*c* continued in this range to the trunk portion 1*d* and can be curved at the radius R in the portion corresponding to the trunk portion 1*d*.

The needle tip 1*a* of the suturing needle A is formed as a sharp tip so as to penetrate through biological tissue by small resistance. The cutting portion 1*c* continued to the needle tip 1*a* includes a portion 1*c*1 having a triangular cross section and a portion 1*c*2 having a trapezoidal cross section. The cutting edge 1*b* is formed on either side of the bottom side across the portions 1*c*1 and 1*c*2. The trunk portion 1*d* continuously includes a portion 1*d*1 having a trapezoidal cross section on the cutting portion is side and a portion 1*d*2 having a Japanese hand drum cross section (the shape including two parallel sides and two opposite arcs interposed between the two sides). No cutting edges are formed on the bottom side of the portion 1*d*1. The cross section of the proximal end 1*e* is formed in a circular shape. A blind hole, not illustrated, attaching the suturing thread is formed in a proximal end face 1*f*.

In this embodiment, the austenitic stainless steel wire formed so as to have a thickness of 0.4 mm by cold drawing is used as the material 1 of the suturing needle A. The material has high hardness and bending strength. The amount of springback in bending is larger than the martensitic stainless steel before thermal treatment.

A bending device B will be described with reference to FIG. 3. In the drawing, a bending die 11 is attached to the frame, not illustrated, so as to be reciprocatively rotated and so as not to be moved when not rotated. A belt 12 having flexibility is wound around the outer circumferential surface of the bending die 11. The belt 12 is pulled out from a supply roll 13*a* arranged on the upstream side, is interposed between the bending die 11 and a press roll 14 as the backup member, and is wound around a winding roll 13*b*. The press roll 14 is arranged on the lower side of the bending die 11. The press roll 14 interposes the belt 12 between the press roll 14 and the bending die 11 and is pressed onto the bending die 11 by an urging member 15.

The thickness of the bending die 11 is set corresponding to the largest radius of the curved portion of the target suturing needle and cannot be uniquely set. When the target suturing needle A is an eye suturing needle, its thickness is about 6 mm. The molded surface having different curvature radii is formed on the outer circumferential surface of the bending die 11 having a thickness of about 6 mm.

A point P on the outer circumferential surface of the bending die 11 is a reference point. The distance between the reference point P and a rotation center O of the bending die 11 corresponds to the curvature radius r from the needle tip 1*a* to the cutting portion 1*c* of the suturing needle A. An arc molded surface 11*a* having the radius r corresponding to a very short range including the needle tip 1*a* as the curved portion of the curvature radius r of the suturing needle A is formed starting from the point P.

The portion of the outer circumferential surface of the bending die 11 corresponding to the curvature radius R of the trunk portion 1*d* of the suturing needle A is formed as an arc molded surface 11*b* having the radius R. A molded surface 11*c* gently changed from the radius r to the radius R from the cutting portion 1*c* to the trunk portion 1*d* of the suturing needle A is formed between the molded surfaces 11*a* and 11*b*.

The unused belt 12 is wound around the supply roll 13*a*, is pulled out by a predetermined length each time the material 1 is bent, and the processed belt is wound around the winding roll 13*b*. After bending the material 1, the belt 12 is wound by a predetermined length. Therefore, when the new material 1 is bent, the new belt 12 is always supplied.

Accordingly, the deformation of the belt 12 due to bending cannot interfere with the bending of the new material 1. The preferable molding can be realized by the clean belt 12.

The press roll 14 is always given a substantially constant force by the urging member 15 and is pressed onto the bending die 11. The urging member 15 should have a function of pressing the press roll 14 onto the bending die 11 by a substantially constant force. Springs such as a pushing spring or a pulling spring and an air cylinder and a hydraulic cylinder which can constantly hold the supply pressure of a fluid can be preferably used.

In this embodiment, the urging member 15 is configured by the air cylinder attached to a sub-frame rotatably supporting the press roll 14.

In the bending device B, the reference point P of the molded surface 11*a* formed on the outer circumferential surface of the bending die 11 is arranged so that it is always located directly thereunder. The bending die 11 is reciprocatively rotated in directions indicated by the arrows a and b so that the material 1 can be bent. The configuration of the driving device rotating the bending die 11 is not limited. The bending die 11 may be driven by a manual operation of an operator and may be driven by an electric motor configured so that the bending die 11 can be reversibly rotated at a constant angle. When a large quantity of the suturing needles A need be manufactured at one time, the bending die 11 is preferably driven by the motor.

The operating procedure for bending the material 1 illustrated in FIG. 2 by the bending device B will be described. It is checked that the point P of the molded surface 11*a* formed on the outer circumferential surface of the bending die 11 is located directly thereunder, that the belt 12 located at the point P is new, and that the press roll 14 presses the bending die 11 by a moderate force.

The needle tip 1*a* of the material 1 is inserted into between the bending die 11 and the belt 12 in the portion in which the bending die 11 and the press roll 14 are pressed and in the point P portion. The bending die 11 is rotated in the direction indicated by the arrow a. With the rotation, the belt 12 and the press roll 14 are moved in the direction indicated by the arrow a. The material 1 is wound between the bending die 11 and the belt 12 and is conveyed in the direction indicated by the arrow a.

In this process, the material 1 is urged by the press roll 14, is pressed into contact with the molded surfaces 11*a*, 11*c*, and 11*b* of the bending die 11, and is pressed into contact with the bending die 11 by the belt 12 for molding. With the rotation of the bending die 11, the distance between the rotation center O of the bending die 11 and the press roll 14 is changed from r to R. The change of the distance is absorbed by the urging member 15 urging the press roll 14. The bending die 11, the belt 12, and the press roll 14 can be smoothly rotated in the direction indicated by the arrow a.

The bending die 11 is rotated at a predetermined angle (the angle from the needle tip 1*a* through the trunk portion 1*d* to the proximal end 1*e* of the material 1) in the direction indicated by the arrow a. After the molding of the material 1 to the proximal end 1*e* is completed, the bending die 11 is rotated in the direction indicated by the arrow b. With the rotation, the belt 12 and the press roll 14 are moved or rotated in the direction indicated by the arrow b. The material 1 is discharged from between the bending die 11 and the belt 12.

The predetermined angle range from the needle tip 1*a* to the cutting portion 1*c* of the discharged material 1 is curved at the curvature radius r. The predetermined angle range of the trunk portion 1*d* is curved at the curvature radius R. The range from the cutting portion 1*c* to the trunk portion 1*d* is curved in a shape in which the curvature radius is gently and continuously changed from the curvature radius r to the curvature radius R.

As described above, the material 1 is bent at one time by the bending device B. The portion from the needle tip 1*a* through the trunk portion 1*d* to the proximal end 1*e* can be curved at different curvature radii and the connection portion having different curvature radii can be curved as a smoothly continued curve.

Second Embodiment

Figure 4:
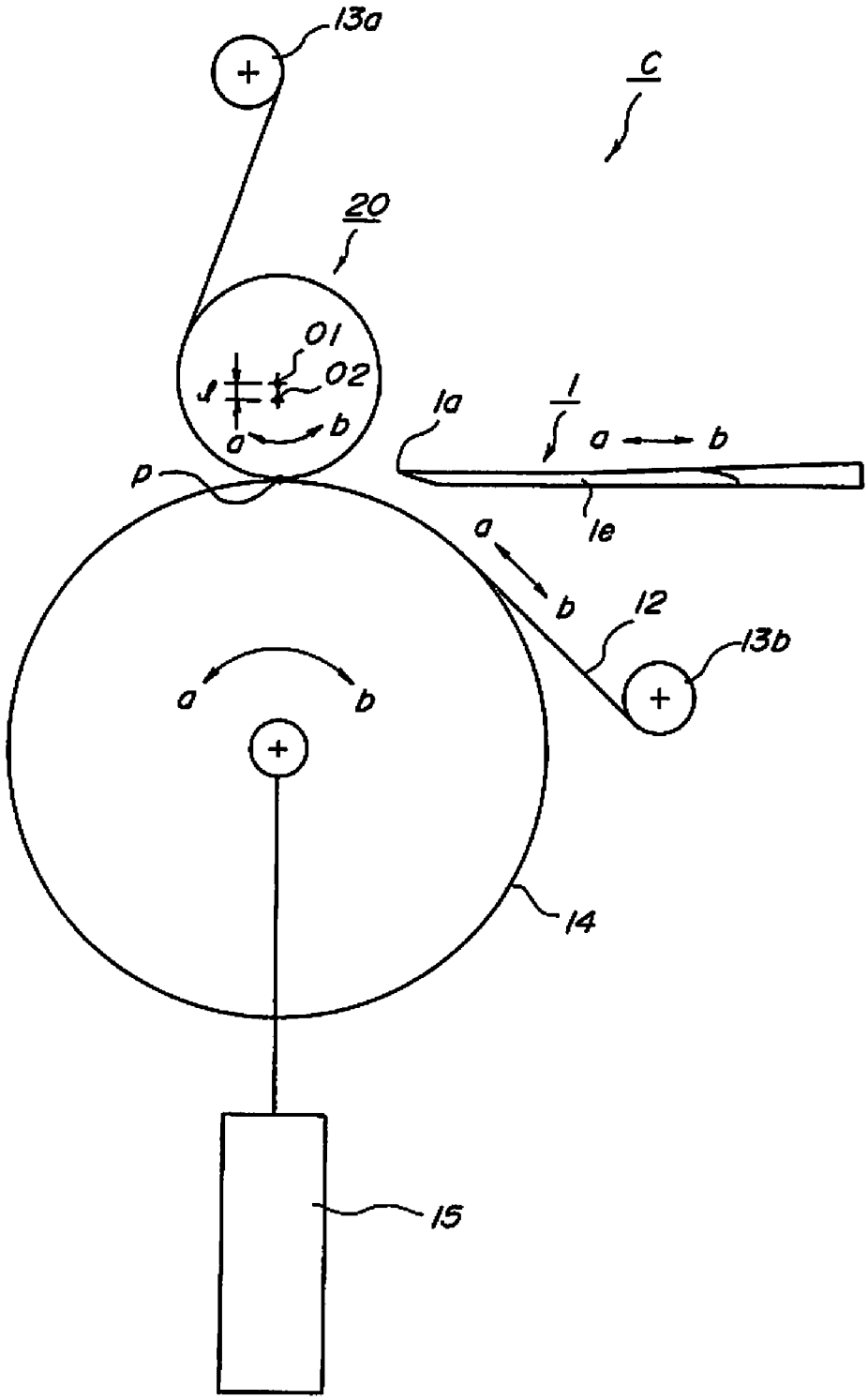
FIG. 4 is a diagram describing the configuration of a bending device performing a bending method according to a second embodiment.
Figure 5:
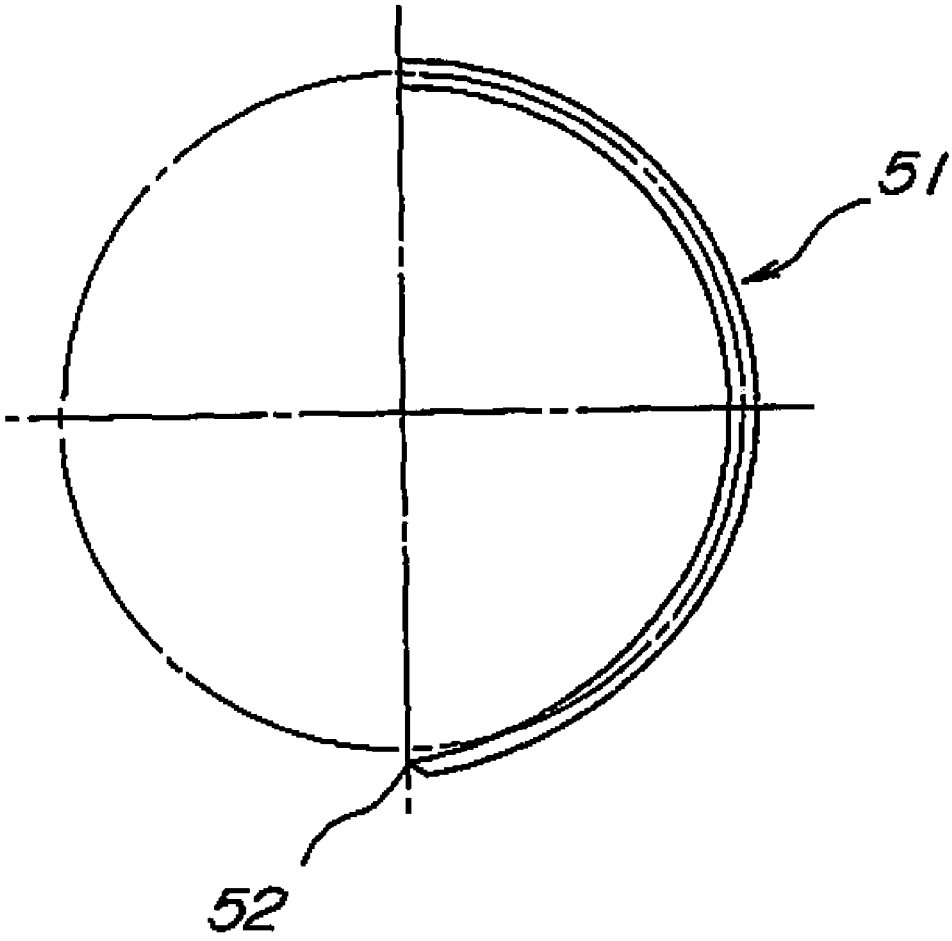
FIG. 5 is a diagram describing part of a problem.

A bending method according to a second embodiment will be described with reference to the drawing. FIG. 4 is a diagram describing the configuration of a bending device performing a bending method according to the second embodiment. The portions having similar functions to the above embodiment in the drawing are indicated by the same reference numerals and the description is omitted.

A bending device C illustrated in the drawing is the same as the bending device B except that the configuration of a bending die 20 is different. In the drawing, the bending die 20 is configured by a cylindrical shaft and a center O1 of the cylindrical shaft and a rotation center O2 of the bending die 20 are separated by a distance 1.

In the bending die 20, the rotation position of the bending die 20 when the extension line of the line connecting the O1 and O2 coincides with the center of the press roll 14 is reference. The radius of the bending die 20 is R. The curvature radius r as the distance from the rotation center O2 to the reference position P of the molded surface is r=R−1. The curvature radius r when the bending die 20 is rotated 90° is r=R. The curvature radius r when the bending die 20 is rotated 180° is r=R+21. The curvature radius r is continuously changed with the rotation of the bending die 20.

The material 1 is bent by the bending device C configured using the bending die 20, the bending die 20 is set to the position where the curvature radius r is minimum (in the state illustrated in FIG. 4). In this state, the material 1 is inserted into between the bending die 20 and the belt 12 to reciprocatively rotate the bending die 20 and the press roll 14 in the directions indicated by the arrows a and b so that the material 1 can be bent.

The bent material 1 is curved at a curvature radius in which the tip portion including the needle tip 1*a* is minimum. In the event that springback is caused after the material 1 is separated from the bending die 20, the curved state can be maintained. The curvature radius r of the bending die 20 is set corresponding to the curvature radius set to the tip portion including the needle tip 1*a* of the target suturing needle and the conditions of the properties of the material. The portion including the needle tip 1*a* can be molded in a curve corresponding to the curved shape of the trunk portion and the proximal end.

Industrial Applicability

The bending method according to the present invention is effective for use for the bicurve needle useful as the eye suturing needle and for molding the tip portion including the sharp needle tip in the same curved shape as the trunk portion and the proximal end.

The invention claimed is:

1. A bending method of a medical suturing needle which uses a bending die which is reciprocatively rotated about a rotation center, and a curvature radius of the bending die having a distance from the rotation center to an outer circumferential surface of the bending die is changed corresponding to a rotation angle of the bending die;

a belt wound around a portion of the outer circumferential surface of the bending die and having flexibility, and a press roll has a larger diameter than the bending die and the belt is interposed between the outer circumferential surface of the bending die and the press roll which are relatively pressed, and the method comprises the steps of:

interposing a rod-shaped medical suturing needle material between the outer circumferential surface of the bending die and the belt in the portion where the outer circumferential surface of the bending die and the press roll are relatively pressed together, reciprocatively rotating the bending die in a winding direction and a rewinding direction, and curving the material in a length direction.

2. The bending method of a medical suturing needle according to claim 1, wherein the curvature radius having a distance from the rotation center to the outer circumferential surface of the bending die is formed corresponding to the curved shape of the medical suturing needle curved at different curvature radii in a length direction from a reference point on the outer circumference to the downstream side in a rotation direction.

3. The bending method of a medical suturing needle according to claim 1, wherein the bending die is formed in a cylindrical shape and the rotation center of the bending die is set to a position eccentric from the center of the cylindrical shape.

4. A bending method for a medical suturing needle which comprises the steps of:

providing a bending die with an outer curvature radius that is changed corresponding to a rotation angle of the bending die;

providing a flexible belt wound around a portion of the outer circumferential surface of the bending die, providing a press roll having a larger diameter than the bending die, interposing a rod-shaped medical suturing needle material between the outer circumferential surface of the bending die and the flexible belt in a location where the outer circumferential surface of the bending die and the press roll are relatively pressed together, and rotating the bending die in a winding direction and then a rewinding direction to thereby curve the rod-shaped medical suturing needle material along its length so the rod-shaped medical suturing needle material is bent with at least two radii of curvature along its length.

* * * * *